US005146887A

United States Patent [19]

Gluchowski et al.

[11] Patent Number: 5,146,887

[45] Date of Patent: Sep. 15, 1992

[54] VALVE ASSEMBLY

[75] Inventors: Paul L. Gluchowski, Rochester; Karl J. Haltiner, Jr., Fairport; David G. Savini, Penfield; Roger M. Brisbane, Spencerport; Daniel F. Smith, Conesus, all of N.Y.

[73] Assignee: General Motors Corporation, Detroit, Mich.

[21] Appl. No.: 827,559

[22] Filed: Jan. 27, 1992

Related U.S. Application Data

[63] Continuation of Ser. No. 743,946, Aug. 12, 1991, abandoned, which is a continuation of Ser. No. 550,313, Jul. 12, 1990, abandoned.

[51] Int. Cl.[5] ..... F02D 9/08

[52] U.S. Cl. ..... 123/337; 123/336

[58] Field of Search ..... 123/337, 336, 585, 586, 123/399; 261/65; 137/630.15; 251/118, 208, 305

[56] References Cited

U.S. PATENT DOCUMENTS

| | | | |
|---|---|---|---|
| 965,322 | 7/1910 | Peterson | 123/337 |
| 3,698,372 | 10/1972 | Eshelman et al. | 123/198 |
| 3,974,855 | 8/1976 | Webb | 137/527.4 |
| 4,094,289 | 6/1978 | Wessel et al. | 123/337 |
| 4,318,386 | 3/1982 | Showalter et al. | 123/590 |
| 4,462,358 | 7/1984 | Ishida et al. | 123/337 |
| 4,474,150 | 10/1984 | Foley et al. | 123/337 |
| 4,491,106 | 1/1985 | Morris | 123/336 |
| 4,519,369 | 5/1985 | Kitamura | 123/337 |
| 4,541,378 | 9/1985 | Kitamura | 123/333 |
| 4,759,326 | 7/1988 | Uthoff, Jr. et al. | 123/337 |
| 4,831,985 | 5/1989 | Mabee et al. | 123/399 |
| 4,836,163 | 6/1989 | Muschalik | 123/337 |
| 4,840,349 | 6/1989 | Peter et al. | 251/129.11 |
| 4,860,706 | 8/1989 | Suzuki et al. | 123/337 |
| 4,905,647 | 3/1990 | Kizer et al. | 251/118 |
| 4,938,452 | 7/1990 | Imamura et al. | 251/305 |
| 4,947,815 | 8/1990 | Peter | 123/399 |
| 4,989,566 | 2/1991 | Wallerand | 123/339 |
| 5,016,586 | 5/1991 | Imamura et al. | 123/336 |
| 5,035,214 | 7/1991 | Daly et al. | 123/337 |

FOREIGN PATENT DOCUMENTS

| | | | |
|---|---|---|---|
| 0076612A1 | 4/1983 | European Pat. Off. . | |
| 837785 | 5/1952 | Fed. Rep. of Germany . | |
| 2829398 | 1/1980 | Fed. Rep. of Germany | 123/337 |
| 3205160A1 | 8/1983 | Fed. Rep. of Germany . | |
| 3800087A | 7/1989 | Fed. Rep. of Germany | 123/337 |
| 504898 | 10/1919 | France | 123/337 |
| 2274461 | 6/1975 | France | 123/337 |
| 62-129538 | 11/1987 | Japan . | |
| 55-164724 | 11/1988 | Japan | 123/337 |
| 01087838 | 11/1989 | Japan . | |
| 2067719A | 12/1980 | United Kingdom . | |

OTHER PUBLICATIONS

European Search Report, 17 Oct. 1991.

*Primary Examiner*—Raymond A. Nelli

*Attorney, Agent, or Firm*—Gordon F. Belcher

[57] ABSTRACT

A valve assembly for regulating air flow to an internal combustion engine comprises a valve body having a valve bore forming an induction passage, and a shaft extending across the valve bore. A valve member is secured to the shaft for rotation in excess of 90 degrees between a nonactuating position and a maximum actuating position. The valve member passes through a zero degree position when rotated from the maximum actuating position to the nonactuating position. The flow area around the valve member when in the zero degree position is less than the flow area when the valve member is in the nonactuating position. A return mechanism urges the valve member toward the nonactuating position when the valve member is rotated away from the nonactuating position.

7 Claims, 3 Drawing Sheets

VALVE ASSEMBLY

This is a continuation of application Ser. No. 07/743946 filed on Aug. 12, 1991 which is a continuation of Ser. No. 07/550313 filed on Jul. 12, 1990, both abandoned.

TECHNICAL FIELD

This invention relates to a valve assembly for regulating the air flow to an internal combustion engine. More particularly, the invention relates to a valve assembly for an electronic throttle control system for an internal combustion engine.

BACKGROUND

Electronic control systems for internal combustion engines frequently utilize a rotatable valve disposed in an engine air induction passage to regulate the air flow through the passage. The valve can be a throttle valve which is positioned by an operator to control air flow to the engine. Air flow to the engine is controlled by varying the flow area around the valve.

The flow area around the valve is geometrically related to the angular position of the valve. In many valve assemblies, proportional changes in the flow area (i.e., the ratio of the flow area change to the flow area) caused by rotation of the valve through a small arc are greater when the valve is near its minimum flow position (i.e., the valve position wherein the air flow area is minimum), as compared to when it is away form the minimum flow position. This is due in part to the flow area being smaller when the valve is near the minimum flow position as compared to when it is away from the minimum flow position. As a result, deviations between the actual and desired valve positions have a more pronounced effect on the flow area when the valve is near the minimum flow position as compared to when it is away from the minimum flow position. Therefore, assuming that the proportional change between the actual and desired flow areas for a given valve position is limited, the permissible deviation between the actual and desired valve positions when the valve is near the minimum flow position is less than the permissible deviation when the valve is away from the minimum flow position. Thus, while it may be possible to limit deviations between the actual and desired valve positions to an acceptable amount when the valve is away from the minimum flow position, it can be difficult to limit such deviations when the valve is near the minimum flow position. If the deviation of the actual valve position from the desired valve position exceeds the permissible amount when the valve is near the minimum flow position, then control of the engine when the flow area is low can be difficult.

Many valve assemblies used to control air flow to vehicle engines return the valve to the minimum flow position when the mechanism which controls the valve position is deactivated. The flow are when the valve is in this position does not typically allow sufficient air flow around the valve to operate the engine in a fast idle condition that allows limp home operation. p Moreover, in some valve assemblies having a valve member supported on a shaft, an axial load along the shaft can cause the valve member to scrape the walls of the valve bore. The wear which can result increases the flow area. This allows additional air flow around the valve member thereby altering the original calibration of the valve assembly. Substantial increases in the minimum flow are can result. This can further decrease control of the air flow to the engine when the flow area is low. Also, scraping by the valve member on the wall of the valve bore can generate friction, and increase deviations between the actual and desired valve positions. Mechanisms to control endplay of a shaft in a valve assembly to minimize such wear are known, but many are difficult to assemble to the valve body.

SUMMARY OF THE INVENTION

The present invention provides a valve assembly for regulating air flow to an internal combustion engine comprising a valve body having a valve bore forming an induction passage, and a shaft extending across the valve bore. A valve member is secured to the shaft for rotation in excess of 90 degrees between a nonactuating position and a maximum actuating position. The valve member passes through a zero degree position when rotated from the maximum actuating position to the nonactuating position. The flow area around the valve member when in the zero degree position is less than the flow area when the valve member is in the nonactuating position. A return means urges the valve member toward the nonactuating position when the valve member is rotated away from the nonactuating position.

The rotation of the valve member in excess of 90 degrees between the maximum actuating and nonactuating positions enables the valve member to pass through the zero degree position and to rotate 90 degrees between the zero degree and maximum actuating positions. Allowing rotation of the valve member through the zero degree position provides additional valve member positions which produce corresponding flow areas. The valve member positions which the valve member initially rotates through after passing through the zero degree position toward the nonactuating position produce low air flow areas. These additional valve positions which produce low air flow areas, when combined with the valve member positions between the zero degree position and maximum actuating position which produce low air flow areas, increase the overall range of valve member positions which produce low flow areas. Thus, when the valve member is near the zero degree position, discrepancies between the desired and actual valve member positions cause lower proportional changes in the flow area. Less precise control mechanisms for the valve position can therefore be used.

Allowing the valve member to rotate 90 degrees between the zero degree and maximum actuating positions allows the maximum actuating position to be defined by the valve member being parallel to the axis of the valve bore. This enables the maximum possible flow area when the valve member is in the maximum actuating position, and a wide range of flow areas between the zero degree and maximum actuating positions.

The flow area when the valve member is in the nonactuating position being larger than the flow area when the valve member is in the zero degree position, results in a number of benefits. First, the nonactuating position can be selected so that, when the mechanism which controls the valve position is deactivated, the flow area allows sufficient air flow around the valve to operate the engine in a fast idle condition that allows limp home operation. Second, the valve member and bore can be sized so that, when the valve member is near the zero degree position, the flow area is sufficiently restricted to allow only enough air flow to the engine to produce a slow idle condition. When in a slow idle condition, the engine noise and fuel consumption are lower, as compared to a fast idle condition. The mechanism which controls the valve position can locate the valve member in the zero degree position when the engine is running but the accelerator pedal is not depressed so that the slow idle condition is the normal idle condition.

The valve member may have a cylindrical peripheral edge and a frustoconical portion formed on the upstream surface of the valve member adjacent to the peripheral edge. The frustoconical portion reduces the change in flow area when the valve is rotated between positions close to the zero degree position, as compared to the same rotations without such a frustoconical portion. The valve assembly may also include a means for limiting axial float or displacement of the shaft across the valve bore.

These and other features and advantages of the invention will be more fully understood from the following description of a specific embodiment of the invention taken together with the accompanying drawings.

BRIEF DRAWING DESCRIPTION

In the drawings.

Corresponding reference characters indicate corresponding parts throughout the several views of the drawings.

DETAILED DESCRIPTION

Figure 1:
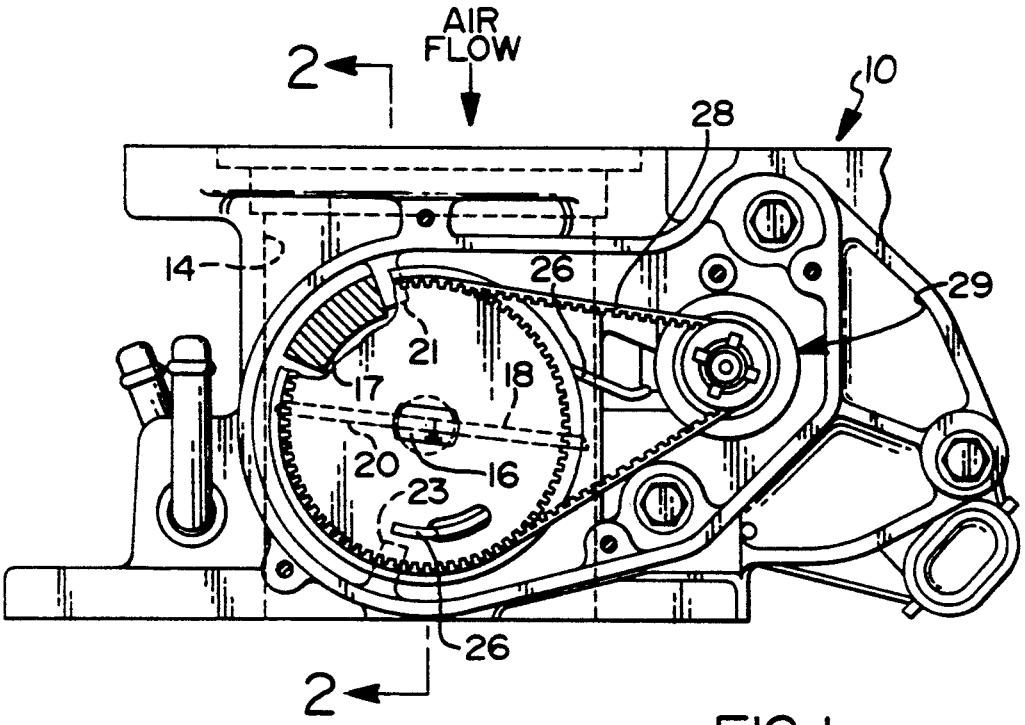
FIG. 1 is an elevational view of the valve assembly of the present invention taken along line 1—1 of FIG. 2 with the end cover removed, and portions of the pulley being broken away to show the shaft boss and nonactuating stop.
Figure 2:
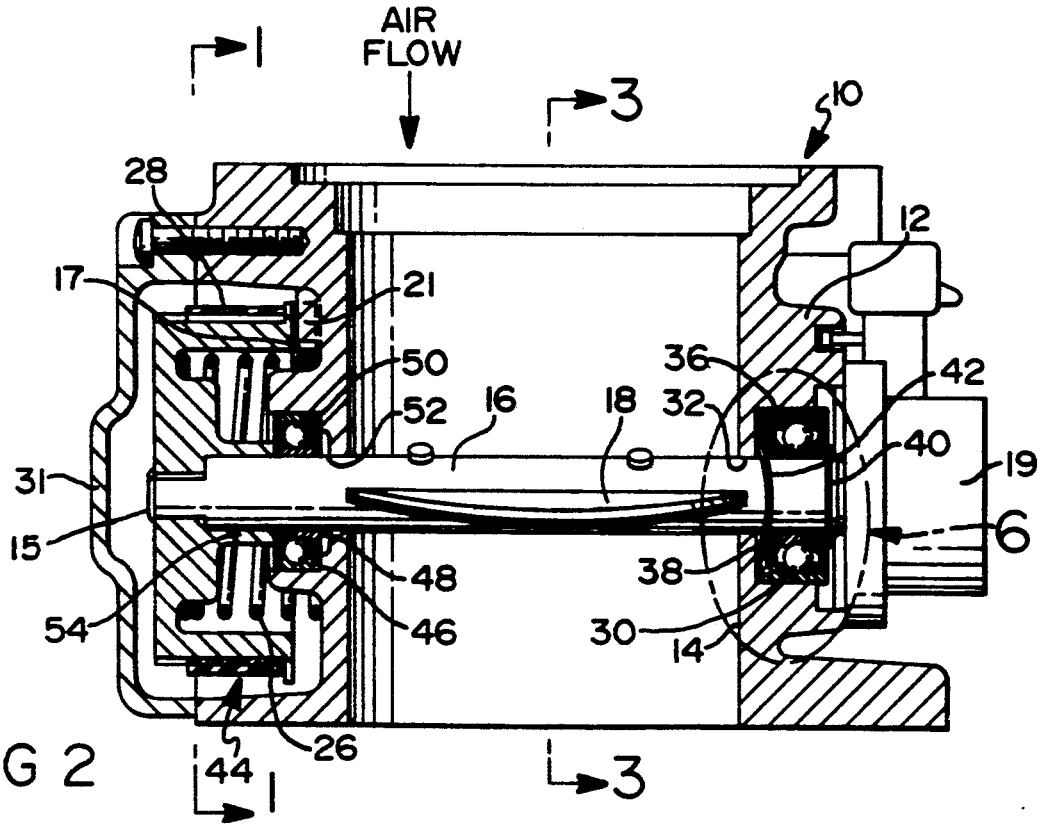
FIG. 2 is a sectional elevational view of the valve of FIG. 1 taken along line 2—2 of FIG. 1 showing the parts connected to each end of the shaft.
Figure 3:
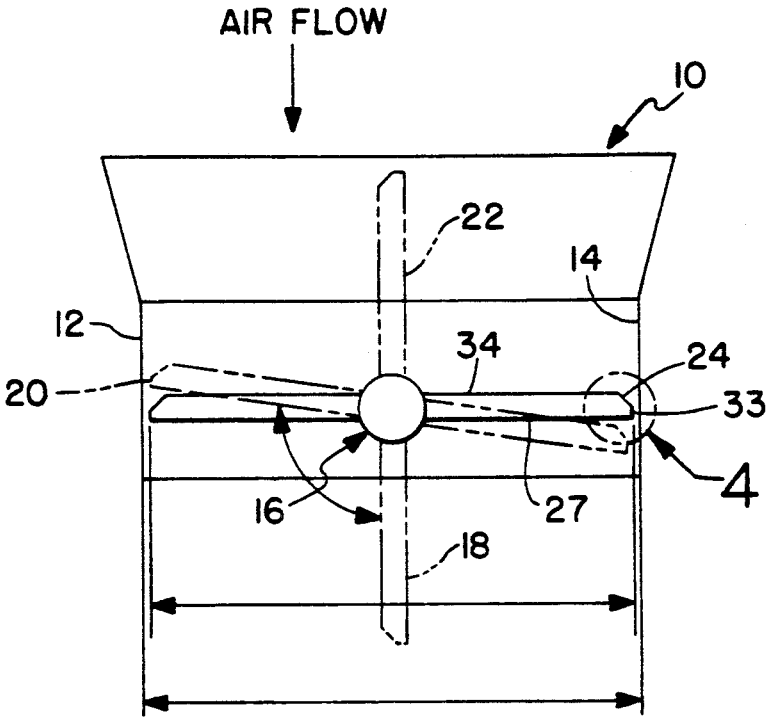
FIG. 3 is a schematic view through the valve assembly taken along line 3—3 of FIG. 2 showing the nonactuating, zero degree and maximum actuating positions of the valve member.

Referring now to the drawings in detail, and in particular FIGS. 1, 2 and 3, numeral 10 generally indicates a valve assembly of the present invention for regulating air flow to an internal combustion engine. The valve assembly 10 comprises a valve body 12 having a valve bore 14 forming an induction passage for air flow to the engine with the valve bore having a generally circular cross section. A shaft 16 has a collar end 13 and a retainer end 15, and is journalled for rotation in the valve body 12. The shaft 16 extends across the valve bore 14 and may be offset from the central axis of the valve bore.

A flat butterfly valve member 18 is secured to the shaft 16 for rotation between a nonactuating position, indicated in phantom by numeral 20, and a maximum actuating position, indicated in phantom by numeral 22, as shown in FIG. 3. As shown in FIG. 3, the valve member 18 passes through a zero degree position, indicated by numeral 27, when rotated from the maximum actuating position 22 to the nonactuating position 20. The valve member 18 has a periphery enclosing an area which is smaller than the cross sectional area of the valve bore 14. The flat surfaces of the valve member 18 may be coined so that they have indentations which form a grid.

The flow area around the valve member 18 is maximum when the valve member 18 is in the maximum actuating position 22. The valve member 18 is typically parallel to the axis of the valve bore 14 when in the maximum actuating position 22. The zero degree position 27 is defined by the valve member 18 being perpendicular to the axis of the valve bore 14. The valve member 18 is rotated approximately 95 degrees between the maximum actuating position 22 and the nonactuating position 20. The rotation of the valve member 18 between the maximum actuating position 22 and the nonactuating position 20 facilitates control of the air flow around the valve member 18.

As shown in FIGS. 1 and 2, a bearing means 44 includes a pulley 54 which is fixed to the retainer end 15. The portion of the shaft ;16 adjoining the retainer end 15 has a double D cross section. The cross section of the shaft 16 away from the retainer end 15 has a circular cross section. When the shaft 16 is inserted into the bore in the pulley 54, the portion of the shaft having a double D cross section coaxially aligns with a portion of the bore in the pulley 54 which has a double D cross section. The remainder of the bore in the pulley 54 through which the shaft 16 extends has a circular cross section. The portion of the bore in the pulley 54 having a circular cross section is larger than the portion of the shaft 16 having a circular cross section enabling a slip fit between those portions of the bore in the pulley and the shaft. The distance between the flats of the bore in the pulley 54 is less than the distance between the flats of the shaft 16 enabling a press fit between the pulley and shaft in the regions of the double D cross sections, as shown in FIG. 2. The retainer end 15 extends beyond the pulley 54 and has a cross section which is larger than the bore in the pulley. An end cover 31 is connected to the valve body 12 to enclose the pulley 54.

The pulley 54 has a boss 17 which engages a nonactuating stop 21 on the valve body 12 when the valve member 18 is in the nonactuating position 20 to limit rotation of the valve member beyond this position, as shown in FIGS. 1 and 2. The boss 17 engages an actuating stop 23 on the valve body when the valve member 18 is in the maximum actuating position 22 to limit rotation of the valve member beyond this position.

A throttle position sensor 19 is connected to the collar end 13 to measure rotation of the shaft 16.

An actuator includes a toothed timing belt 28 which wraps around corresponding teeth on the pulley 54 to produce rotation of the valve member 18. The actuator includes a motor 29 having a toothed pulley which the timing belt 28 also wraps around. The motor 29 rotates its pulley to cause displacement of the timing belt 28 to rotate the valve member 18. An adjustable tensioner can enable adjustment in the distance between the shaft 16 and the pulley of the motor 29 to adjust the tension in the timing belt 28.

Figure 4:
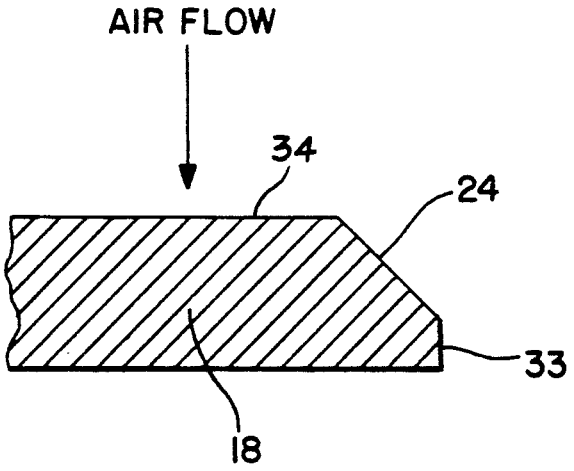
FIG. 4 is an enlarged view of the portion of FIG. 3 circled by line 4 showing the frustoconical portion and peripheral edge of the valve member.

The valve member 18, shown in FIGS. 3 and 4, has a cylindrical peripheral edge 33. The thickness of the peripheral edge 33 is less than the thickness of the valve member 18 away from the peripheral edge. The valve member 18 has an upstream surface 34 which includes a frustoconical portion 24 adjoining the peripheral edge 33, as shown in FIG. 4.

A return means 26, such as a single element torsional spring, acts on the pulley 54 when the valve member 18 is rotated away from the nonactuating position 20 causing the pulley 54 to rotate the shaft 16 so that the valve member is rotated toward the nonactuating position. The return means 26 produces a small axial force against the pulley 54 which urges the pulley away from the valve bore 14 along the axis of the shaft 16.

Figure 5:
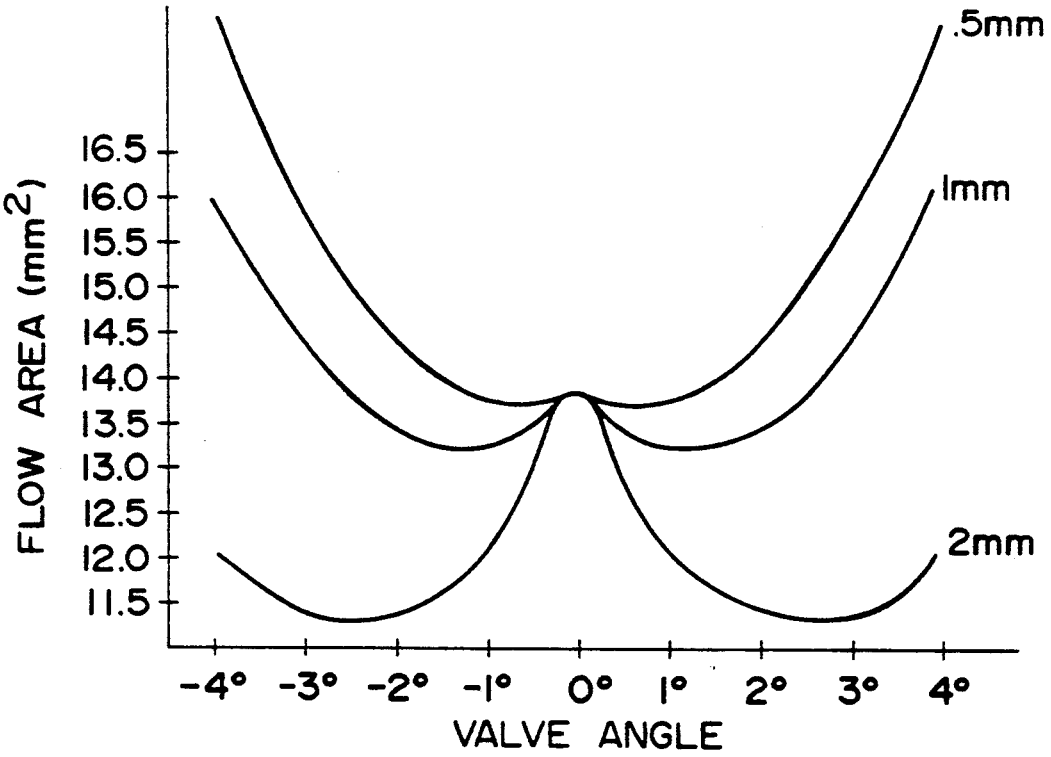
FIG. 5 is a graph showing the flow area allowed by the valve assembly of FIG. 1 for various angles of the valve member and for various thicknesses of the peripheral edge of the valve member.
Figure 6:
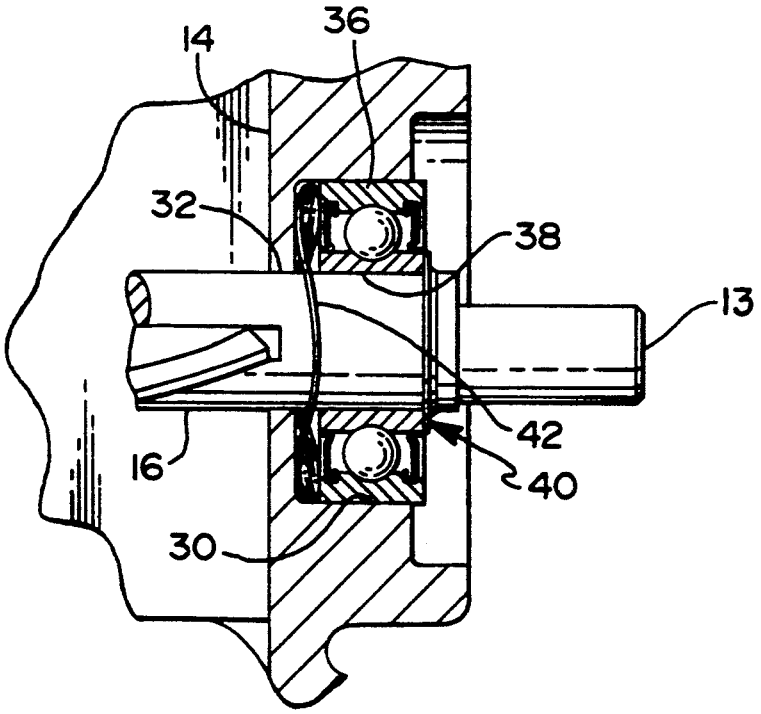
FIG. 6 is an enlarged view of the portion of FIG. 2 circled by line 6 showing the collar bearing which limits end play, and the throttle position sensor removed.

FIG. 5 is a graph showing the flow area of the valve assembly 10 for various angles of the valve member 18 and for various thicknesses of the peripheral edge 33. The graph is based on theoretical calculations. The flow area is the area of the space between the valve member 18 and the valve bore 14 perpendicular to the axis of the valve bore. The flow area is varied by rotating the valve member 18. The variations in thickness of the peripheral edge 24 are produced by varying degrees of thickness reduction produced by the frustoconical portion 24. A valve angle of 0° corresponds to the valve member 18 being in the zero degree position.

FIG. 5 illustrates the value of the frustoconical portion 24, since it results in a gradual change in flow area produced by rotation of the valve member 18 near the zero degree position. This improves control of the engine when the valve member 18 is near the zero degree position 27 since small discrepancies between the desired and actual valve member positions do not produce large proportional changes in the flow area and therefore do not substantially affect engine output. The peripheral edge 33, in combination with the frustoconical portion 24, enables these control improvements while also allowing the valve member 18 away from the peripheral edge 33 to be sufficiently thick for strength requirements. The valve member 18 is preferably 2 mm thick, with the frustoconical portion 24 producing a peripheral edge 33 having a thickness of 0.5 mm.

FIG. 5 also illustrates the capability of the valve assembly 10 to allow engine operation if the motor 29 does not actuate the valve member 18 since under such conditions, the return means 26 will urge the shaft 16 to rotate the valve member to the nonactuating position 20. When the valve member 18 is in the nonactuating position 20 (i.e., rotated approximately 5 degrees beyond the zero degree position 27 away from the maximum actuating position 22), the flow area is sufficient to allow sufficient air to flow to the engine to operate it in a fast idle condition that allows limp home operation.

Another advantage of the valve assembly 10 is that the boss 17 is away from the nonactuating stop 21 when the valve member 18 is in the zero degree position 27 which is typically the position of the valve member 18 during normal engine idling. This reduces the likelihood of the shaft boss 17 contacting the nonactuating stop 21 when the engine is normally idling.

A collar socket 30 is formed in the outer surface of the valve body 12. The collar socket 30 has an axis which is perpendicular to the valve bore 14. The collar socket 30 has a collar socket opening 32 enabling the collar end 13 of shaft 16 to extend through the collar socket.

A collar bearing comprising a ball bearing having a collar outer race 36 and a collar inner race 38 is disposed in the collar socket 30 so that the collar end 13 extends through the collar inner race 38. The collar inner race 38 has an inner diameter which is sized to enable a slip fit between the collar inner race 38 and shaft 16. The collar outer race 36 has an outer diameter which is sized to enable a slip fit between the collar outer race and collar socket 30.

A thrust collar 40 comprising a clip is secured to the shaft 16, by a press fit. A resilient washer 42 is disposed between the collar outer race 36 and collar socket 30.

A retainer socket 50 is formed in the outer surface of the valve body 12. The retainer socket 50 has an axis which coincides with the axis of the collar socket 30. The retainer socket 50 has a retainer socket opening 52 enabling the retainer end 15 of shaft 16 to extend through the retainer socket.

The bearing means 44 includes a retainer bearing comprising a ball bearing having a retainer outer race 46 and a retainer inner race 48. The retainer bearing is disposed in the retainer socket 50 so that the retainer end 15 extends through the retainer inner race 48. The retainer inner race 48 has an inner diameter which is sized to enable a slip fit between the retainer inner race 48 and shaft 16. The pulley 54, which constitutes a thrust retainer, engages the retainer inner race 48.

The resilient washer 42 urges the collar outer race 36 away from the valve body 12 along the axis of the shaft 16. This causes the collar outer race 36 to urge the collar inner race 38 against the thrust collar 40 which in turn urges the collar end 13 of the shaft 16 away from the valve body 12 along the axis of the shaft. As a result, the shaft 16 pulls the pulley 54 toward the valve body 12 along the axis of the shaft. The pulley 54 then engages the retainer inner race 48 and urges it toward the valve body 12 along the axis of the shaft 16. This causes the retainer inner race 48 to urge the retainer outer race 46 in the same direction causing the retainer outer race to bottom out against the valve body 12 in the retainer socket 50. A predetermined clearance is thereby maintained between the valve member 18 and valve bore 14. The resilient washer 42 can also deflect or expand in accordance with changes in the distance between the collar socket opening 32 and collar bearing, along the axis of the shaft 16, which can occur during temperature changes if the shaft and valve body 12 have different coefficients of thermal expansion. This enables the retainer outer race 46 to remain bottomed out against the valve body 12 in the retainer socket 50 thereby maintaining the selected clearance between the valve member 18 and valve bore 14.

While the invention has been described by reference to a preferred embodiment, it should be understood that numerous changes could be made within the spirit and scope of the inventive concepts described. Accordingly, it is intended that the invention not be limited to the disclosed embodiment, but that it have the full scope permitted by the language of the following claims.

We claim:

1. A valve assembly for regulating air flow to an internal combustion engine, said valve assembly comprising:

a valve body having a valve bore forming an induction passage for air flow to the engine;

a shaft having opposite ends which are journalled for rotation in said valve body, said shaft extending across said valve bore;

a flat butterfly valve member having a periphery enclosing an area which is smaller than the cross sectional area of said valve bore, said valve member being secured to said shaft rotation between a nonactuating position and a maximum actuating position to vary the flow area around said valve member, the flow area being maximum when said valve member is in said maximum actuating position, said valve member being rotated in excess of 90 degrees between said maximum actuating and nonactuating positions, said valve member passing through a zero degree position when rotated from said maximum actuating position to said nonactuating position, said zero degree position being defined by said valve member being perpendicular to the axis of said valve bore, the flow area around said valve member when in said zero degree position being less than the flow area around said valve member when in said nonactuating position; and a return means being adapted to urge said valve member toward said nonactuating position when said valve member is rotated away from said nonactuating position.

2. A valve assembly as set forth in claim 1 wherein a collar socket is formed in the outer surface of said valve body, said collar socket having an axis which is perpendicular to said valve bore, said collar socket having a collar socket opening enabling a collar end of said shaft to extend into said collar socket, said valve assembly further comprising:

a collar bearing comprising a ball bearing having a collar outer race and a collar inner race disposed in said collar socket so that said collar end extends through said collar inner race, said collar inner race having an inner diameter being sized to enable a slip fit between said collar inner race and shaft, said collar outer race having an outer diameter being sized to enable a slip fit between said collar outer race and collar socket;

a thrust collar secured to said shaft between said collar bearing and collar end;

a resilient washer disposed between said collar outer race and collar socket wherein engagement between said thrust collar and collar inner race, and engagement between said collar outer race and resilient washer limits displacement of said collar end toward said valve bore along the axis of said shaft; and a bearing means connected to said shaft between said valve body and a retainer end of said shaft, said bearing means being adapted to limit displacement of said retainer end toward said valve bore along the axis of said shaft.

3. A valve assembly as set forth in claim 2 wherein a retainer socket is formed in the outer surface of said valve body, said retainer socket having an axis which coincides with the axis of said collar socket, said retainer socket having a retainer socket opening through which said retainer end extends; said bearing means comprising:

a retainer bearing comprising a ball bearing having a retainer outer race and a retainer inner race disposed in said retainer socket so that said retainer end extends through said retainer inner race, said retainer inner race having an inner diameter being sized to enable a slip fit between said retainer inner race and shaft; and a thrust retainer secured to said shaft between said retainer bearing and retainer end wherein engagement between said thrust retainer and said retainer inner race, and engagement between said retainer outer race and said retainer socket limits displacement of said retainer end toward said valve bore along the axis of said shaft.

4. A valve assembly as set forth in claim 1 wherein said valve bore has a circular cross section, said valve member has a cylindrical peripheral edge, the thickness of said peripheral edge being less than the thickness of said valve member away from said peripheral edge.

5. A valve assembly as set forth in claim 4 wherein said valve member has an upstream surface, said upstream surface having a frustoconical portion adjoining said peripheral edge.

6. A valve assembly as set forth in claim 4 wherein the thickness of said peripheral edge is approximately 0.5 mm.

7. A valve assembly as set forth in claim 4 wherein the thickness of said peripheral edge is approximately 0.25 times the thickness of said valve member away from said peripheral edge.

* * * * *